US006168549B1

(12) United States Patent
Squibb et al.

(10) Patent No.: US 6,168,549 B1
(45) Date of Patent: Jan. 2, 2001

(54) LEG ASSEMBLY FOR BALANCE BEAM

(75) Inventors: Neal C. Squibb, Scranton; Sue M. Sherlock, Jefferson, both of IA (US); Bill W. Sorenson, West Port, CT (US)

(73) Assignee: American Sports International, Ltd., Jefferson, IA (US)

( * ) Notice: Under 35 U.S.C. 154(b), the term of this patent shall be extended for 0 days.

(21) Appl. No.: 09/400,245

(22) Filed: Sep. 21, 1999

(51) Int. Cl.[7] ..... A63B 21/00
(52) U.S. Cl. ..... 482/34
(58) Field of Search ..... 248/345.1; 267/148; 5/309, 312; 297/312, 452.49, 452.48; 482/34, 38, 41, 23

(56) References Cited

U.S. PATENT DOCUMENTS 5,037,086 8/1991 Strand .
5,454,772 * 10/1995 Rodden ..... 482/54
5,562,575 * 10/1996 Gvoich ..... 482/52
5,885,189 * 3/1999 Lang et al. ..... 482/38
6,013,011 * 1/2000 Moore ..... 482/54
6,068,578 * 5/2000 Wang ..... 482/54

* cited by examiner

*Primary Examiner*—Jerome W. Donnelly
(74) *Attorney, Agent, or Firm*—Zarley, McKee, Thomte, Voorhees & Sease

(57) ABSTRACT

A balance beam utilizing a conventional beam member with pivotally mounted leg members. The leg members are mounted in a clevis secured to the bottom surface of the beam by a pin which extends through aligned bores in the clevis and leg members. The leg members have floor support members, upwardly extending sections rigidly secured to the center of the floor members, and horizontal sections rigidly secured to upwardly extending leg sections. Secured to the horizontal leg sections are removable resilient bumpers that engage the lower surface of the beam. When a gymnast lands on the beam, the weight of gymnast compresses the bumpers moving the beam to a lower horizontal position. The immediate recovery of the bumpers imparts some impetus to the gymnast as the gymnastic routine continues.

7 Claims, 4 Drawing Sheets

LEG ASSEMBLY FOR BALANCE BEAM

BACKGROUND OF THE INVENTION

Gymnastic balance beams are comprised of elongated rigid body members elevated from a floor surface by rigidly attaching legs mounted directly under the body member and normally positioned at opposite ends thereof. For training purposes, the balance beams are elevated a short distance from the floor.

When a gymnast performs on the balance beam, the full weight of the gymnast is impacted on the beam a number of times in a typical routine. The rigid beam absorbs little, if any, of the impact of the gymnast, and provides no spring to the gymnast as the routine is continued following the moment of impact.

Reflex mechanisms to absorb the weight of the impact on the beam, such as U.S. Pat. No. 5,037,086 by Strand, are well known but cannot be elevated a short distance from the floor for training purposes.

It is therefore the principle object of this invention to provide a balance beam with a reflex mechanism which will both absorb some of the impact of the gymnast's weight, and which will provide some impetus to the gymnast immediately following the moment of impact, that can be elevated a short distance from the floor surface.

A further object of this invention is to provide a balance beam with a reflex mechanism which is safe, durable, and easily serviced or repaired.

A further object of this invention is to provide a balance beam with a reflex mechanism which is easy to adjust to correspond to the weights of different gymnasts.

These and other objects will be apparent to those skilled in the art.

BRIEF SUMMARY OF THE INVENTION

A balance beam is disclosed which utilizes a conventional beam member with leg members wherein the upper section of the leg members are pivotally mounted to the lower surface of the beam. The leg members comprise a support member, a first leg section which extends upwardly and a second leg section which extends horizontally and substantially parallel to the beam. A clevis is secured to the lower surface of the beam. The second leg section is connected at its first end to the lower surface of the beam by a pin which extends through aligned bores in the clevis and second leg section. A bumper is secured to the second leg section at the second end and engages the lower surface of the beam.

When the gymnast lands on the beam, the weight of the gymnast causes the bumper to compress which partially absorbs the impact of the gymnast's weight. The immediate recovery of the bumper imparts some impetus to the gymnast as the gymnastic routine is continued immediately after the moment of impact. At the moment of impact, the beam moves from a first horizontal position to a slightly lower horizontal position as the bumper compresses downwardly.

DESCRIPTION OF THE PREFERRED EMBODIMENT

Figure 1:
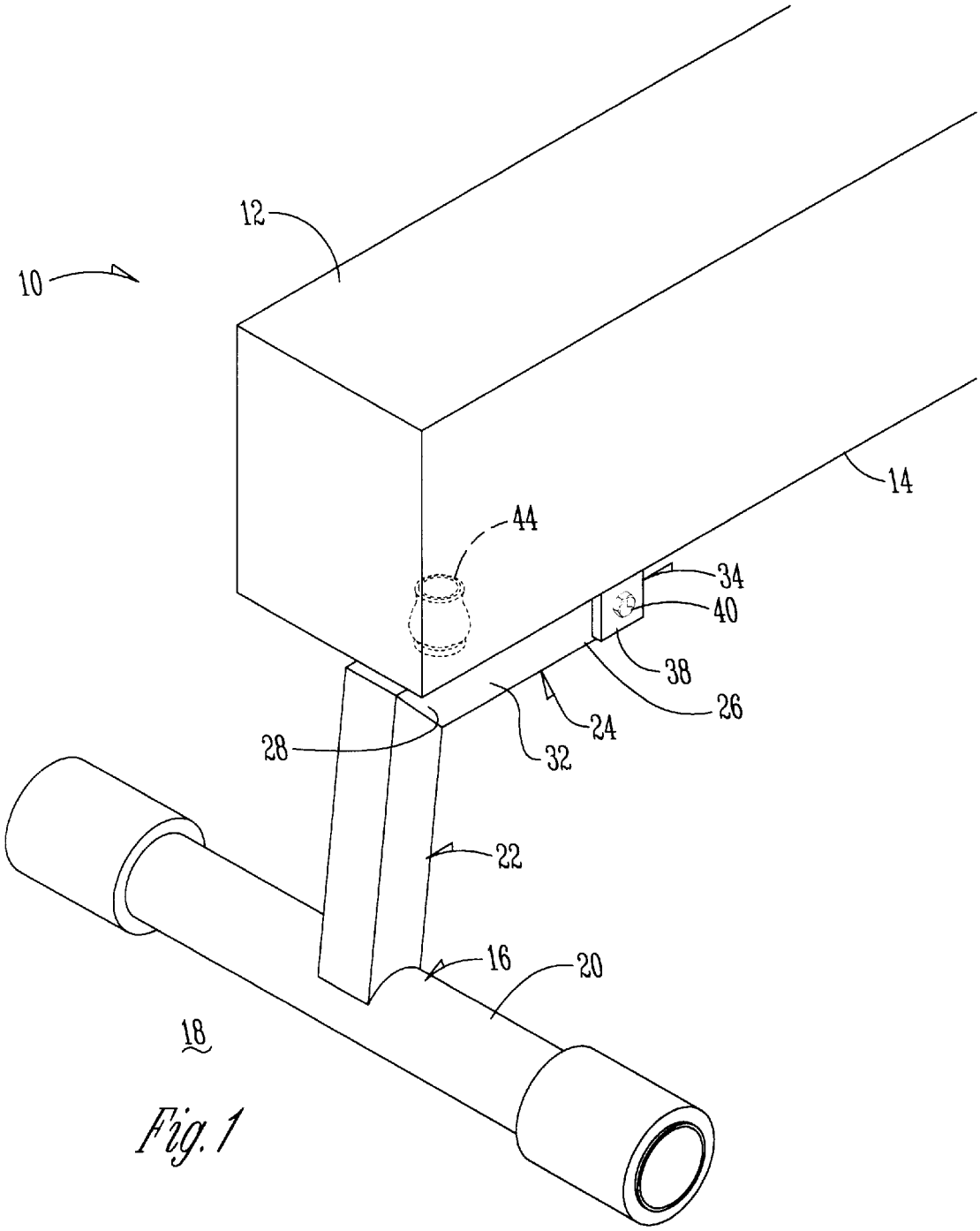
FIG. 1 is a perspective view of the balance beam of this invention.
Figure 2:
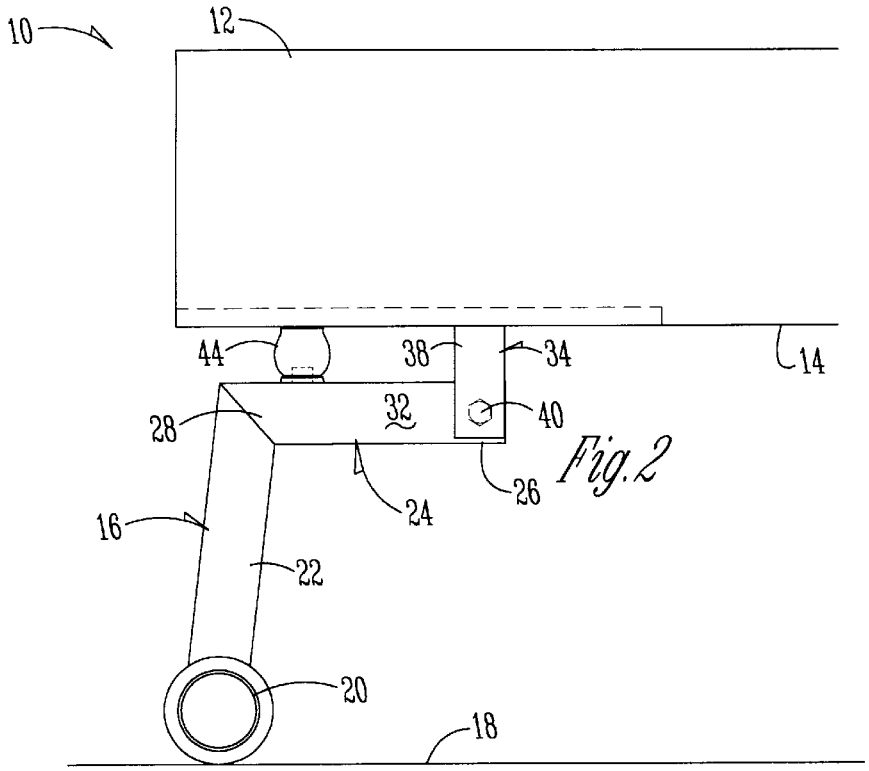
FIG. 2 is a side view of the balance beam with the bumper engaging the balance beam.

The conventional balance beam 10 has a top surface 12 and a bottom surface 14. Legs 16 extend upwardly from a supporting floor surface 18 and are operatively connected to the bottom surface 14 of beam 10 as described hereafter.

Legs 16 are composed of T-shaped members which are comprised of transverse floor engaging horizontal members 20, upright first sections 22 rigidly secured to the center of members 20 and extending upwardly therefrom, and horizontal second sections 24 rigidly secured to the upper end of sections 22. Sections 22 and 24 form an inverted L-shape. The second sections 24 have a first end 26 and a second end 28 with the first end 26 having a bore 30 extending through the sides 32 of the sections 24.

Figure 5:
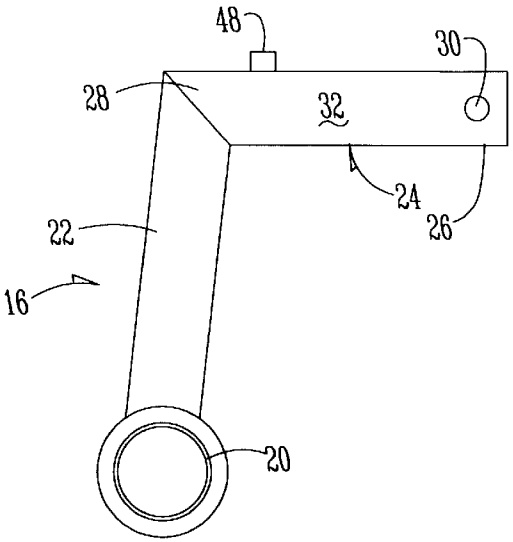
FIG. 5 is a side view of the leg assembly without the bumper or clevis.
Figure 4:
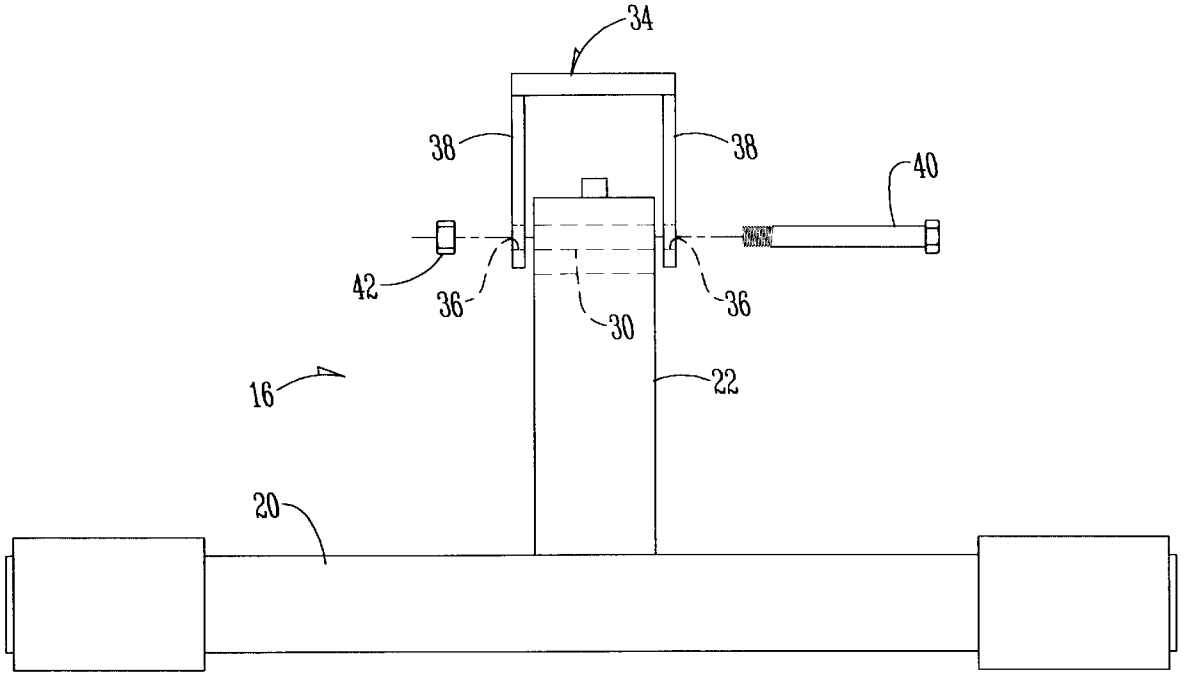
FIG. 4 is an end view of the leg assembly.

A clevis 34 is secured to the bottom surface 14 of the beam 10 in any conventional manner. The clevis 34, which has apertures 36 extending through sides 38 (FIG. 4) is positioned to engage the first end 26 of sections 24 (FIG. 5). The vertical orientation of the clevis 34 could be altered to serve equally well with a leg section of a different shape or configuration. The space between the sides 38 of the clevis 34 permit sections 24 to fit therein. When bores 30 are aligned with apertures 36, a pin 40 is extended through the aligned bores and secured with a conventional bolt 42 to allow for pivotal movement of the legs 16 in relation to the beam 10 about the axis of the pin 40 (FIG. 4).

Figure 6:
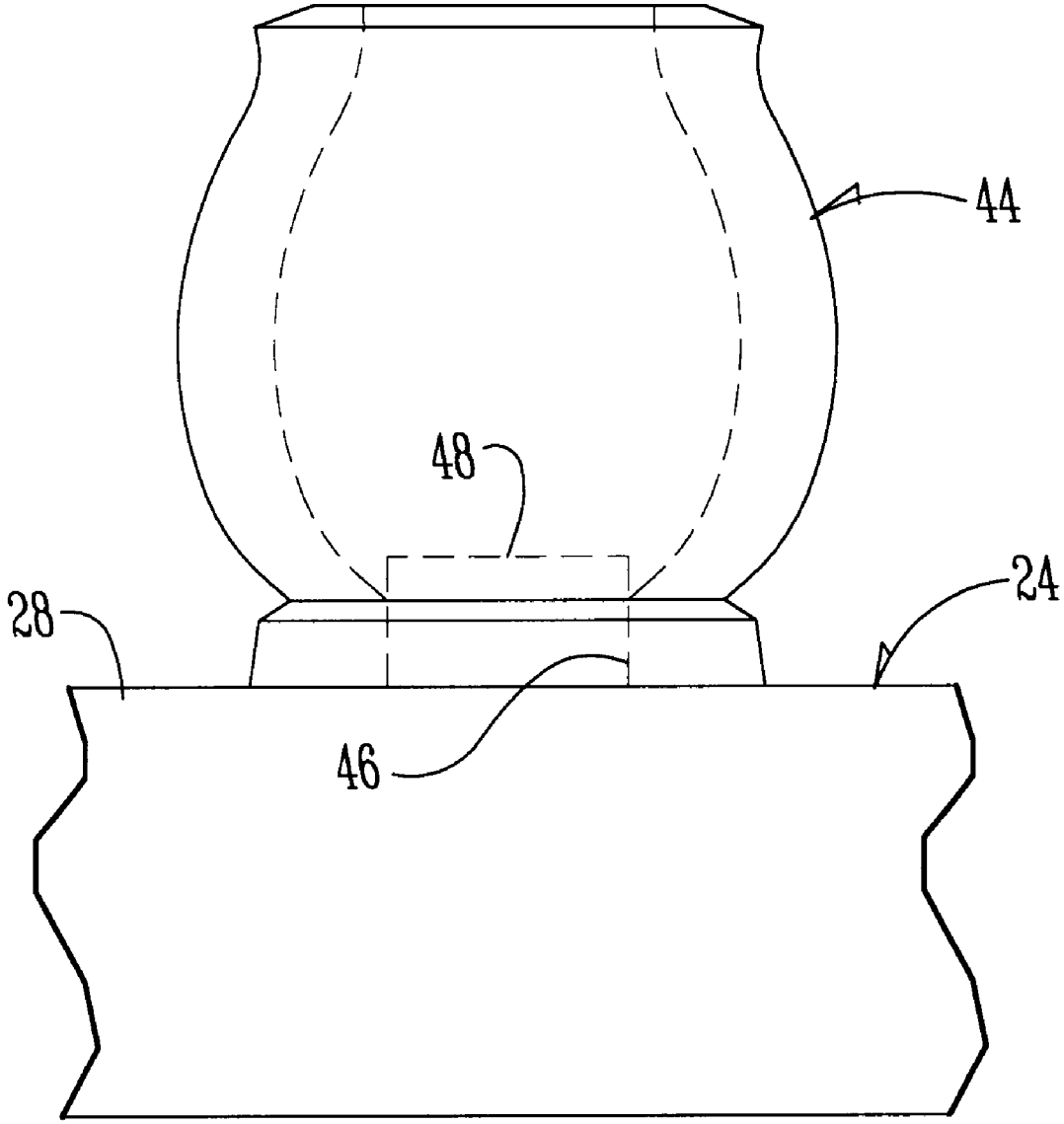
FIG. 6 is an enlarged scale view of the bumper.

Resilient bumpers 44 are secured to the upper surface 46 of sections 24 at the second end 28. The bumpers 44 are hollow and have an open top. An aperture 46 in the bottom of the bumpers 44 frictionally fits over lugs 48 welded to the top of sections 24 (FIG. 6). The bumpers 44 can be made of any rubber, polyurethane or thermoplastic material such as the TecsPak® bumpers manufactured by Miner Elastomer Products Corporation of St. Charles, Ill. The bumpers 44 are removable from lugs 48 and made with different resistant strengths to adapt to the different weights of gymnasts. A flat piece of rubber (not shown) with an aperture therein to receive lugs 48 would be an acceptable substitute for bumpers 44. As indicated above, bumpers 44 do not have to be vertically oriented if functioning with a leg section of a diagonal leg section, for example.

Figure 3:
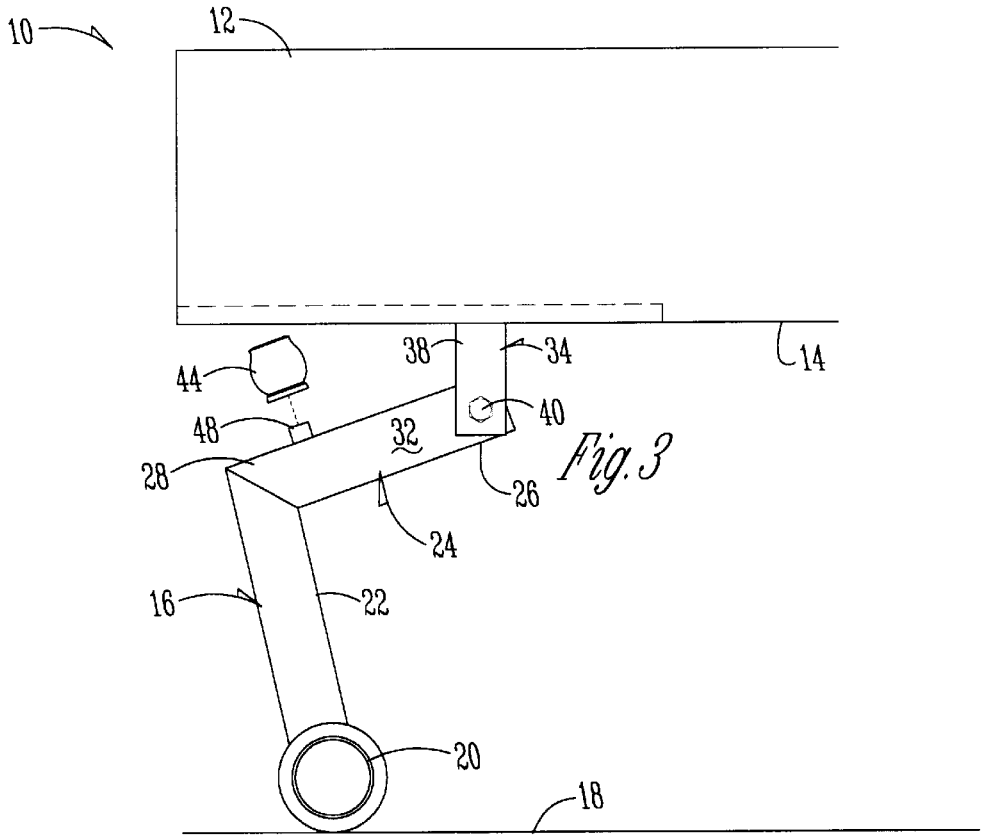
FIG. 3 is a side view of the balance beam showing the leg assembly pivoted for assembly of the bumper.

The bumpers 44 can be removed by rotating the pivoting leg 16 away from the beam 10 about the pin 40 axis, detaching the bumpers 44 from the second sections 24, and replacing the bumpers 44 with bumpers 44 of a different resistance (FIG. 3).

When the weight of the gymnast is impacted upon beam 10 during various aspects of a gymnastic routine, the bumpers 44 are forced downwardly and are compressed. This causes the height of the beam 10 to move to a slightly lower position. As soon as the impact of the gymnast is absorbed by the bumpers 44, the bumpers 44 expand and return the beam 10 to the original position. This movement is rapid and virtually imperceptible. Nevertheless, it adds to the safety, comfort and utility of the device. The bumpers 44 can be easily replaced when persons of different weights use the device. Heavier persons will use stiffer bumpers, while small children will use a lighter, more resilient bumper.

The feature of resiliency and reflex has therefore been added to the conventional balance beam with a leg assembly that can be elevated a short distance from the floor surface.

It is therefore seen that this invention will achieve at least its stated objectives.

What is claimed is:

1. A gymnastic device comprising:

an elongated substantially rigid gymnastic body member having upper and lower surfaces, a support means to hold the body member in an elevated substantially horizontal position, comprising spaced apart leg members extending from a floor support upwardly towards the lower surface of said body member, the leg members each having a leg section extending horizontally and substantially parallel to the lower surface of said body member, a bracket member pivotally connecting said leg section to the lower surface of said body member, a resilient bumper secured to the leg section of said leg member and engaging the lower surface of said body member permitting said body member to move to a slightly lower horizontal position when said body member is impacted by the weight of a gymnast performing thereon.

2. The device of claim 1 wherein said body member is a balance beam.

3. The device of claim 1 wherein said leg section is supported at one end by a vertical leg section supported at a lower end thereof by a floor engaging member.

4. The device of claim 1 wherein the bumper is removably secured to the leg section.

5. The device of claim 1 wherein the leg members have an inverted L-shape.

6. A gymnastic device comprising:

an elongated substantially rigid horizontal gymnastic body member having upper and lower surfaces, a support means to hold the body member in an elevated substantially horizontal position, comprising spaced apart leg members extending from a floor support upwardly towards the lower surface of said body member, a bracket member pivotally connecting said leg section to the lower surface of said body member, a resilient bumper operatively positioned between the leg member and the body member to cushion the impact of a gymnast performing on the body member, and means holding the resilient bumper against longitudinal horizontal movement to permit the resilient bumper to compress in a vertical direction when cushioning the impact of a gymnast performing on the body member.

7. The device of claim 1 wherein the bumper is secured to the leg section by a lug on the leg section that is received in an aperture in the bumper.

* * * * *